US008521047B2

(12) United States Patent
Sasaki et al.

(10) Patent No.: US 8,521,047 B2
(45) Date of Patent: Aug. 27, 2013

(54) IMAGE FORMING APPARATUS AND TONER CONCENTRATION SENSOR

(75) Inventors: Satoru Sasaki, Toyokawa (JP); Yoshiki Katayama, Toyokawa (JP); Hirotada Seki, Toyokawa (JP); Natsuyo Higashi, Toyokawa (JP); Shigetaka Kato, Shinshiro (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 182 days.

(21) Appl. No.: 13/220,927

(22) Filed: Aug. 30, 2011

(65) Prior Publication Data

US 2012/0051770 A1 Mar. 1, 2012

(30) Foreign Application Priority Data

Aug. 31, 2010 (JP) ..... 2010-193374

(51) Int. Cl.
*G03G 15/00* (2006.01)

(52) U.S. Cl.
USPC ..... 399/49; 399/58; 399/61; 399/62

(58) Field of Classification Search
USPC ..... 399/38, 46, 49, 58–62, 64, 65; 430/30
See application file for complete search history.

(56) References Cited

U.S. PATENT DOCUMENTS

| | | | | |
|---|---|---|---|---|
| 4,273,843 | A * | 6/1981 | Fujita et al. | 430/30 |
| 5,410,388 | A * | 4/1995 | Pacer et al. | 399/49 |
| 6,774,999 | B2 * | 8/2004 | Franzen et al. | 356/425 |
| 7,580,662 | B2 | 8/2009 | Murayama | |
| 7,869,724 | B2 | 1/2011 | Yamasaki et al. | |
| 8,045,872 | B2 | 10/2011 | Hirata et al. | |

FOREIGN PATENT DOCUMENTS

| | | | |
|---|---|---|---|
| JP | 09-068829 | A | 3/1997 |
| JP | 10-333416 | A | 12/1998 |
| JP | 2001-347593 | A | 12/2001 |
| JP | 2002-148887 | A | 5/2002 |
| JP | 2006-259278 | A | 9/2006 |
| JP | 2007-199425 | A | 8/2007 |
| JP | 2008-233369 | A | 10/2008 |
| JP | 2009-020402 | A | 1/2009 |
| JP | 2010-054576 | A | 3/2010 |

OTHER PUBLICATIONS

Office Action (Notification of Reason(s) for Refusal) dated Aug. 22, 2012, issued in corresponding Japanese Patent Application No. 2010-193374, and an English Translation thereof. (6 pages).

* cited by examiner

*Primary Examiner* — Hoan Tran
(74) *Attorney, Agent, or Firm* — Buchanan Ingersoll & Rooney PC

(57) ABSTRACT

An image forming apparatus includes a toner carrier, a toner image forming unit, and a toner concentration sensor. The toner carrier includes a transparent film. The toner image forming unit forms a toner image onto the toner carrier. The toner concentration sensor senses the concentration of toner on the toner carrier. The toner concentration sensor includes first and second light emitting elements and a light receiving element. The light emitting elements each radiate light directly or indirectly to the toner carrier. The light receiving element receives reflecting light originating from the light emitting elements. The first light emitting element radiates light having a wavelength of a predetermined reflectance resulting from direct radiation to the toner carrier. The second light emitting element radiates light having a wavelength that causes a lower reflectance resulting from direct radiation to the toner carrier than a reflectance resulting from radiation to the toner.

18 Claims, 8 Drawing Sheets

IMAGE FORMING APPARATUS AND TONER CONCENTRATION SENSOR

CROSS-REFERENCE TO RELATED APPLICATIONS

The present application claims priority under 35 U.S.C.§119 to Japanese Patent Application No. 2010-193374, filed Aug. 31, 2010. The contents of this application are herein incorporated by reference in their entirety.

BACKGROUND OF THE INVENTION

1. Field of the Invention

The present invention relates to an image forming apparatus and a toner concentration sensor.

2. Discussion of the Background

Some of electrophotographic image forming apparatuses use toner. For example, in color printing, a toner image is first-transferred to a toner carrier at an image processing unit. The toner carrier is then brought into contact with a sheet of recording medium conveyed in a predetermined direction to second-transfer the toner image to the sheet. The image transferred to the sheet is then fixed at a fixing unit. The electrophotographic image forming apparatuses use feedback control including measuring toner concentrations prior to the second transfer to reflect the measured toner concentrations to the forming conditions of toner images.

Reflective concentration sensors are used to measure toner concentrations. A reflective concentration sensor irradiates toner with light using a light emitting element of LED or other material. The light that reflects from the toner is received by the reflective concentration sensor at its light receiving element of a photodiode or other material. The reflective concentration sensor converts the received light into electrical energy and calculates a toner concentration based on the intensity of the electrical energy. That is, reflective concentration sensors utilize the phenomenon that light reflectance changes in accordance with toner concentration.

Color image forming apparatuses use four colors of toner, namely, yellow, magenta, cyan, and black. The yellow, magenta, and cyan colors of toner contain many diffuse reflection components. In view of this, diffuse reflection light is used to measure the concentrations of color toner. For the black toner, which completely absorbs light, specular reflection light is used.

Japanese Unexamined Patent Application Publication No. 10-333416 discloses means for sensing the concentration of a toner image of a plurality of colors. Specifically, a plurality of light emitting elements are used to emit different wavelengths of light that are predetermined in accordance with the spectral reflectances of the plurality of colors of toner. In accordance with the color of toner to be sensed, a corresponding one of the light emitting elements is used to emit light. This ensures a highly sensitive measurement of concentration for individual colors.

Japanese Unexamined Patent Application Publication No. 2002-148887 discloses a concentration sensing device that includes two light emitting elements. One of the light emitting elements is designed for specular reflection light to sense the concentration of black toner. The other light emitting element is designed for diffuse reflection (scattering reflection) to sense the concentration of colored toner. It is somewhat time-consuming to stabilize the amount of light radiated from the light emitting elements. In view of this, a certain specific timing is used for light emission of the light emitting element for specular reflection light and the light emitting element for diffuse reflection. This ensures a highly accurate and high speed measurement of the concentration of the toner image.

The contents of Japanese Unexamined Patent Application Publication No. 10-333416 and Japanese Unexamined Patent Application Publication No. 2002-148887 are herein incorporated by reference in their entirety.

Incidentally, when reflective devices are used to sense toner concentration, their sensitivity increases as the incident angle of the incident light and the reflection angle of reflecting light reduce (the incident light is radiated from the light emitting element and incident on the toner carrier, and the reflecting light is reflecting from the toner image toward the light receiving element).

Further, some intermediate transfer belts serving as toner carriers have transparent films deposited over elastic substrates. In this case, incident light is first refracted on the surface of the transparent film and then reflected on the surface of the substrate. This indicates that the spectral reflectance of an intermediate transfer belt varies depending on the thickness of the transparent film and on the incident angle.

The conventional techniques, such as those disclosed in Japanese Unexamined Patent Application Publication Nos. 10-333416 and 2002-148887, give no consideration to the fact that the spectral reflectance varies depending on the thickness of the transparent film of the intermediate transfer belt and on other parameters. Accordingly, the light for specular reflection and the light for diffuse reflection are set at the same spectral reflectance. More specifically, the light for specular reflection and the light for diffuse reflection on toner both end up with specular reflection on the intermediate transfer belt.

However, if the light for diffuse reflection on toner undergoes specular reflection on the intermediate transfer belt and then enters the light receiving element, the sensing of toner concentration is inaccurate. In view of this, a conventional light emitting element to sense toner concentration by diffuse reflection has an optical axis that is spaced apart from the optical axis of the light receiving element, in an attempt to prevent specular reflection light from the intermediate transfer belt from entering the light receiving element. This necessitates the light emitting element and the light receiving element to be spaced apart from one another. This in turn increases the incident angle and the reflection angle of light on the intermediate transfer belt for one light emitting element, causing a problem of degraded sensitivity (accuracy) to toner concentration.

Additionally, another light emitting element among the plurality of light emitting elements needs to be set to emit light to undergo specular reflection on the intermediate transfer belt. This necessitates the plurality of light emitting elements to be spaced apart from each other, causing a problem of an enlarged concentration sensing device.

SUMMARY OF THE INVENTION

According to one aspect of the present invention, an image forming apparatus includes a toner carrier, a toner image forming unit, and at least one toner concentration sensor. The toner carrier includes a substrate and a transparent film on a surface of the substrate. The toner image forming unit is configured to form a toner image onto the toner carrier. The at least one toner concentration sensor is configured to sense a concentration of toner carried on the toner carrier. The toner concentration sensor includes a first light emitting element, a second light emitting element different from the first light emitting element, and at least one light receiving element.

The first light emitting element and the second light emitting element are each configured to radiate light directly or indirectly to the toner carrier. The at least one light receiving element is configured to receive reflecting light originating from at least one of the first light emitting element and the second light emitting element. A reflection intensity of the reflecting light originating from the at least one of the first light emitting element and the second light emitting element and received by the at least one light receiving element is used to sense the concentration of the toner. The first light emitting element is configured to radiate light having a wavelength that causes equal to or higher than a predetermined reflectance that is sensed by the at least one light receiving element when the light is radiated directly to the toner carrier. The second light emitting element is configured to radiate light having a wavelength that is different from the wavelength of the light radiated from the first light emitting element and that causes a lower reflectance resulting when the light is radiated directly to the toner carrier than a reflectance resulting when the light is radiated to the toner.

According to another aspect of the present invention, a toner concentration sensor includes a first light emitting element, a second light emitting element different from the first light emitting element, and at least one light receiving element. The first light emitting element and the second light emitting element are each configured to radiate light directly or indirectly to a toner carrier. The toner carrier includes a substrate and a transparent film over the substrate. The at least one light receiving element is configured to receive reflecting light originating from at least one of the first light emitting element and the second light emitting element. The reflecting light is used to sense toner carried on the toner carrier. The first light emitting element is configured to radiate light having a wavelength that causes equal to or higher than a predetermined reflectance when the light is radiated directly to the toner carrier. The second light emitting element is configured to radiate light having a wavelength that is different from the wavelength of the light radiated from the first light emitting element and that causes a lower reflectance resulting when the light is radiated directly to the toner carrier than a reflectance resulting when the light is radiated to the toner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2A is a schematic perspective view of the toner concentration sensor, and FIG. 2B is an exploded perspective view of the toner concentration sensor;

DESCRIPTION OF THE EMBODIMENTS

Figure 1:
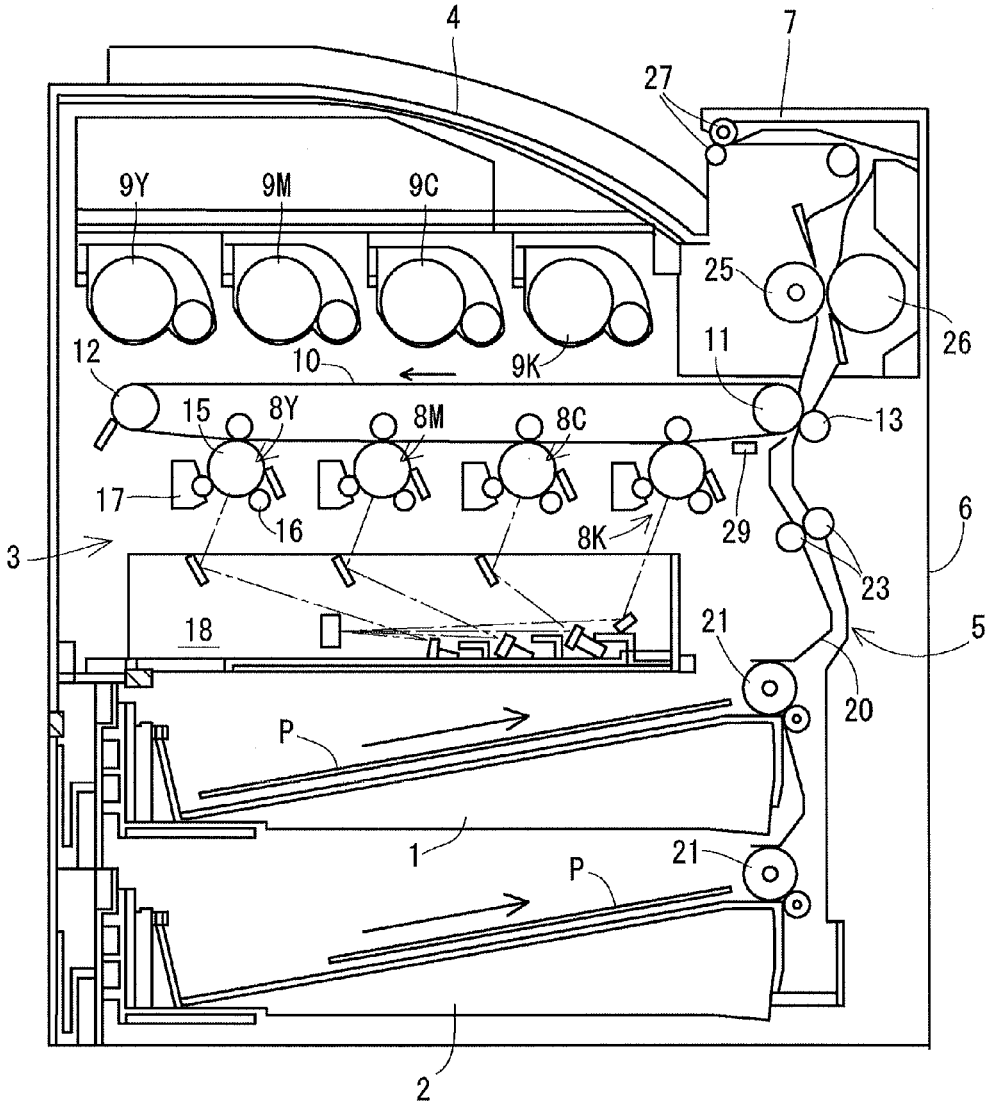
FIG. 1 is a schematic cross-sectional view of a printer according to an embodiment.

The embodiments will now be described with reference to the accompanying drawings, wherein like reference numerals designate corresponding or identical elements throughout the various drawings.

As used herein, the term "image forming apparatus" encompasses various machines, apparatuses, and appliances with printing functions. Examples include, but not limited to, monofunctional machines with printing functions such as copiers, printers, and facsimiles, and multifunctional machines with printing, scanning, communication, and other functions.

As used herein, the term "predetermined reflectance or a higher reflectance" refers to, for example, equal to or more than one-half a maximum spectral reflectance.

The embodiments of the present invention are each applied to a printer. First, an overview of the printer will be described by referring to FIG. 1.

(1) Overview of a Printer

As shown in FIG. 1, a printer includes two-stage feeding cassettes 1 and 2, an image processing unit 3 disposed above the feeding cassettes 1 and 2, a collection tray 4 disposed above the image processing unit 3, and a conveyer path (feeding unit) 5 through which sheets of paper P are conveyed from the feeding cassettes 1 and 2 toward the collection tray 4. The collection tray 4 is exposed on the top surface of a housing 6 that defines the exterior of the printer. An operation unit 7 is also disposed on the top surface of the housing 6.

The printer is full color-enabled. Specifically, the image processing unit 3 includes four image forming units 8Y, 8M, 8C, and 8K respectively corresponding to yellow Y, magenta M, cyan C, and black K; and four toner storage units 9Y, 9M, 9C, and 9K that correspond to the respective four colors. The four image forming units 8Y, 8M, 8C, and 8K are arranged with the yellow image forming unit 8Y farthest from the conveyer path 5 and the black image forming unit 8K closest to the conveyer path 5. A toner image is first-transferred from the image forming units 8Y, 8M, 8C, and 8K to an intermediate transfer belt 10.

The intermediate transfer belt 10 is looped across a drive roller 11 disposed adjacent to the conveyer path 5 and an idler roller 12 disposed further outward than the yellow image forming unit 8Y. The toner image carried by the intermediate transfer belt 10 is second-transferred to a sheet of paper P. The sheet of paper P is pressed onto the intermediate transfer belt 10 by a second-transfer roller 13.

The image forming units 8Y, 8M, 8C, and 8K each include a photosensitive drum 15, a charging roller 16, and a developer 17. The toner image is transferred from the photosensitive drum 15 to the intermediate transfer belt 10. The conveyer path 5 includes a pair of guides 20, and the sheets of paper P accumulated in the feeding cassettes 1 and 2 are sent to the conveyer path 5 on a one-by-one basis by pick-up rollers 21. The conveyer path 5 also includes a pair of timing rollers 23 at a portion that is further downstream than the feeding cassettes 1 and 2 and further upstream than the second-transfer roller 13. The sheet of paper P loaded with the toner image that is second-transferred from the intermediate transfer belt 10 is pressed between a fixing roller 25 and a pressure roller 26, where the toner image is fixed. The sheet of paper P is discharged into the collection tray 4 through between discharge rollers 27.

(2) Structure of Main Components

Toner concentration sensors 29 are disposed adjacent to the circumference of the intermediate transfer belt 10 at a portion that is slightly behind the drive roller 11 in the circumferential direction. This will be described by also referring to FIGS. 2A and 2B and later drawings. While two toner concentration sensors 29 are disposed along the width direction of the intermediate transfer belt 10, the toner concentration sensors 29 may be set at any other number and location.

Figure 2B:
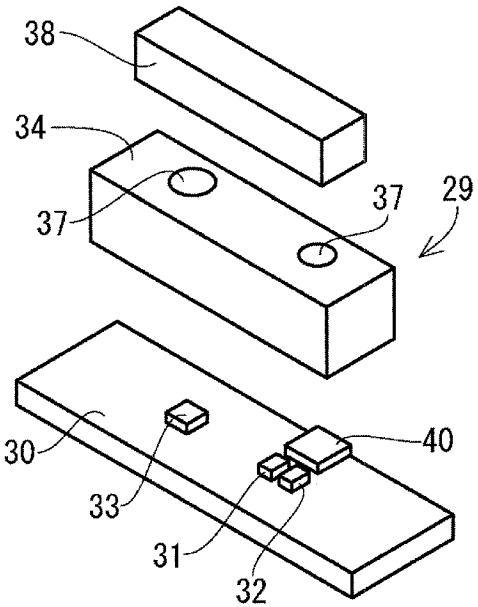
FIGS. 2A and 2B schematically show a toner concentration sensor according to a first embodiment.
Figure 2A:
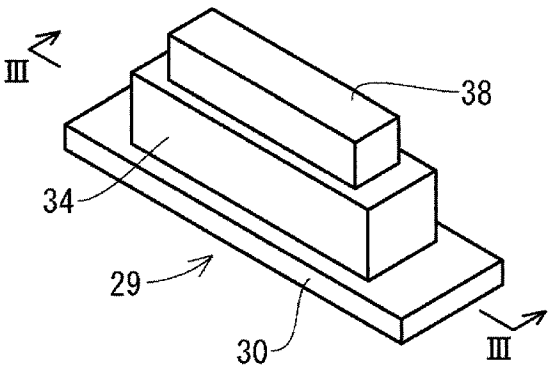
Figure 3:
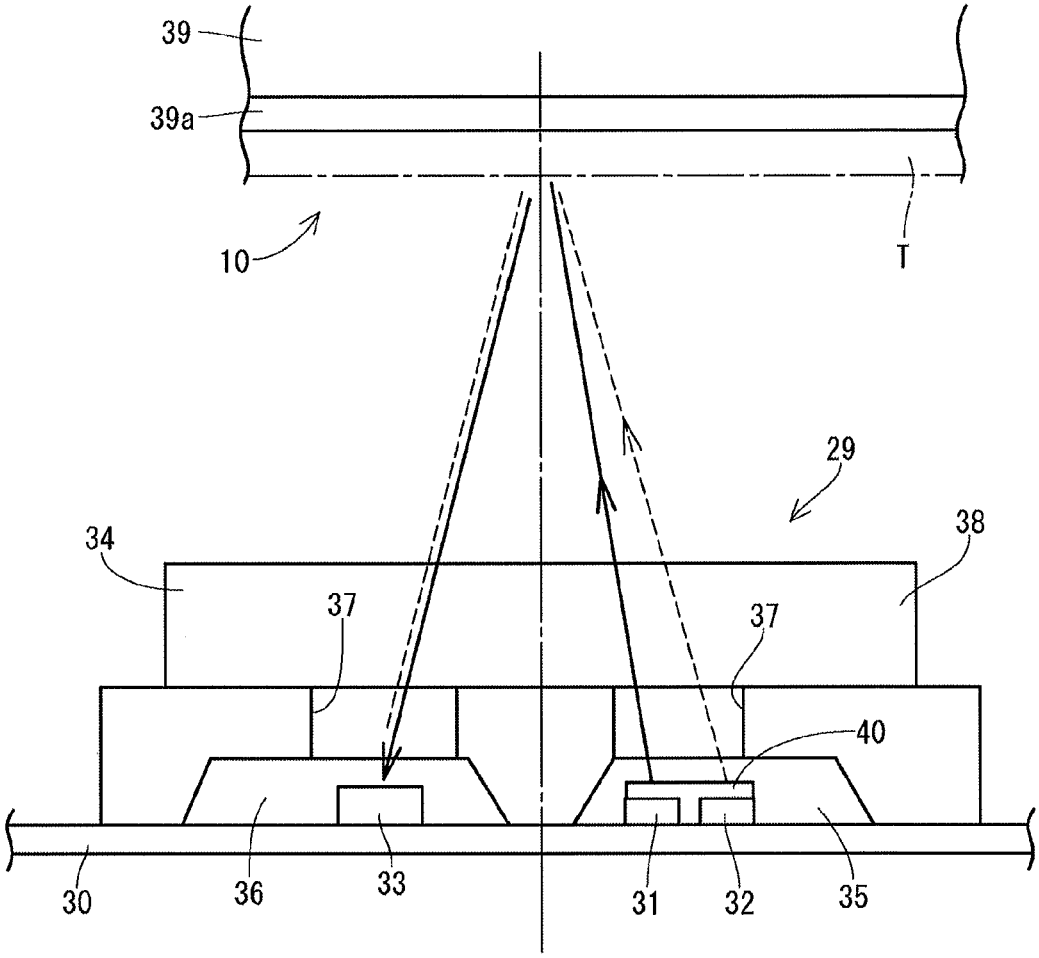
FIG. 3 is a cross-sectional view, taken along the line III-III in FIG. 2A, of the toner concentration sensor when in use (that is, the cross-section is viewed from a direction orthogonal to the circumferential direction of an intermediate transfer belt) (hatching is omitted)

As shown in FIGS. 2A, 2B, and 3, each of the toner concentration sensors 29 includes a print substrate 30, first and second light emitting elements 31 and 32 mounted to the print substrate 30, and a main light receiving element 33 mounted to the print substrate 30 to convert reflecting light originating from the first and second light emitting elements 31 and 32 into electrical energy. The main light receiving element 33 is aligned with the first and second light emitting elements 31 and 32, and the first and second light emitting elements 31 and 32 are arranged adjacent to one another. The first and second light emitting elements 31 and 32 are LEDs, for example, and the main light receiving element 33 is a photodiode, for example.

The group of elements 31-33 is covered by a holder 34 of opaque material. The holder 34 has a first depression 35 to accommodate the first and second light emitting elements 31 and 32 and a second depression 36 to accommodate the light receiving element 33. The first and second depressions 35 and 36 each communicate with a thorough, light-transmitting hole 37. A lens 38 is secured to the top surface of the holder 34.

Also on the print substrate 30, a subsidiary light receiving element 40 is disposed adjacent to the first and second light emitting elements 31 and 32. The subsidiary light receiving element 40 senses the amount of light radiated from the first and second light emitting elements 31 and 32. The amount of light received by the subsidiary light receiving element 40 is compared with the amount of light received by the main light receiving element 33. This results in the ratio of the light incident on the light receiving element 33 to the radiated light.

Figure 4:
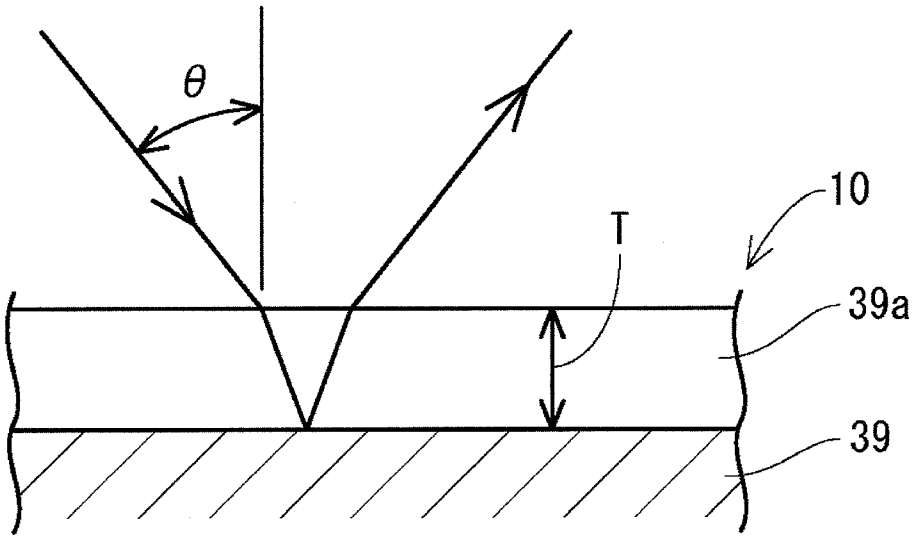
FIG. 4 is a partially enlarged cross-sectional view of the intermediate transfer belt.

As shown in FIGS. 3 and 4, the intermediate transfer belt 10 has a multi-layer structure of a substrate 39 such as of a PPS resin film and a transparent film 39*a* integrally disposed over the substrate 39. The transparent film 39*a* is made of, for example, $SiO_2$ and has a uniform thickness due to deposition. As shown in FIG. 4, light enters the transparent film 39*a* and is reflected by the surface of the substrate 39 to go out of the intermediate transfer belt 10. The spectral reflectance in this case varies depending on the thickness T of the transparent film 39*a* and on the incident angle θ.

(3) Specific Configuration

Figure 5:
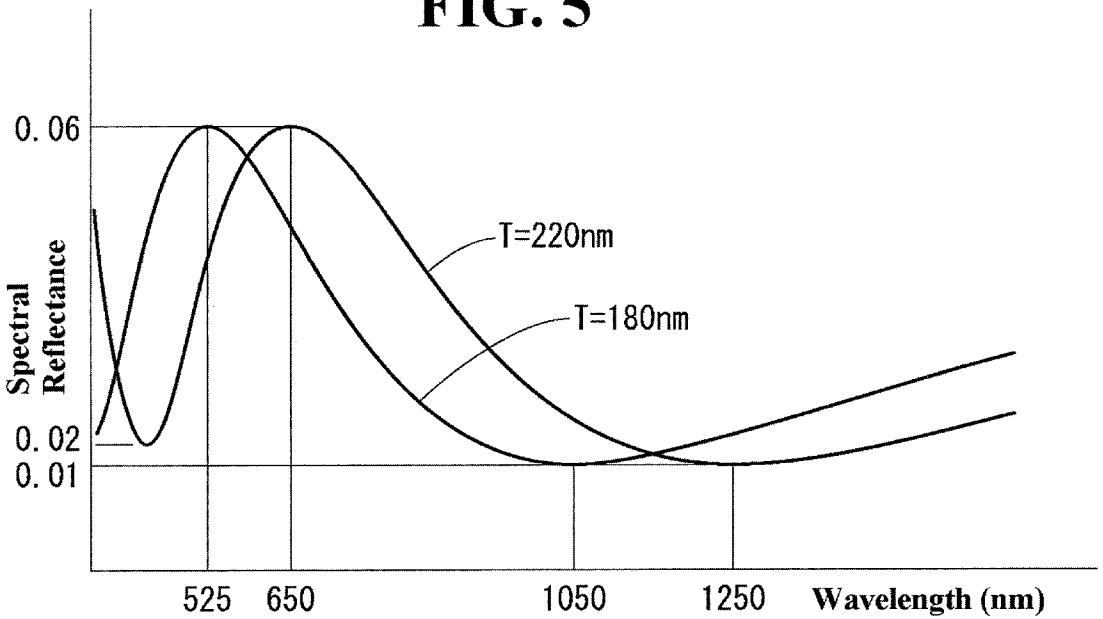
FIG. 5 is a graph showing the thickness of a transparent film in relation to spectral reflectance and wavelength.

FIG. 5 shows the thickness of the transparent film 39*a* in relation to spectral reflectance and wavelength. Interference occurs to intensify or weaken the reflecting light. This phenomenon makes the spectral reflectance maximum at a wavelength of 650 nm and minimum at a wavelength of 1250 nm when the transparent film 39*a* has a thickness of 220 nm. When the transparent film 39*a* has a thickness of 180 nm, the phenomenon makes the spectral reflectance maximum at a wavelength of 525 nm and minimum at a wavelength of 1050 nm. Thus, FIG. 5 gives an insight into the spectral reflectance varying depending on the thickness of the transparent film 39*a*. From another viewpoint, the relationship between the spectral reflectance and the wavelength greatly depends on the thickness of the transparent film 39*a*.

The first light emitting element 31 is used not only to sense toner concentrations but also to sense surface conditions of the intermediate transfer belt 10. Specifically, while the intermediate transfer belt 10 not loaded with toner makes one cycle of circumferential movement, the first light emitting element 31 emits light to the intermediate transfer belt 10 and the light receiving element 33 senses reflecting light so as to sense a change in output. Generally, the tolerance of output change is equal to or lower than 10%.

It is assumed that the transparent film 39*a* has a thickness T variation tolerance of ±10 nm. In this case, the resulting reflectance is equal to or lower than 10% even though the thickness of the transparent film 39*a* varies within the variation tolerance. This necessitates a 5% or lower spectral reflectance of the transparent film 39*a* relative to the maximum emission wavelength of the first light emitting element 31. Accordingly, at T=220 nm, the emission wavelength of the first light emitting element 31 is set between 590 nm and 690 nm. In this respect, the emission wavelengths of the first and second light emitting elements are equal to respective peak wavelengths.

The second light emitting element 32 emits light having a wavelength that causes a lower reflectance resulting when no toner is attached to the intermediate transfer belt 10 than the reflectance resulting when toner is attached to the intermediate transfer belt 10. Accordingly, when the thickness of the transparent film 39*a* is 220 nm and the minimum spectral reflectance of the toner is assumed to be 0.015, the emission wavelength of the second light emitting element 32 needs to be set within the range of approximately 1170-1400 nm. It should be noted, however, that in this case the range varies depending on the reflectance of toner, and therefore the range is set in accordance with the reflectance of toner that is used.

Figure 6:
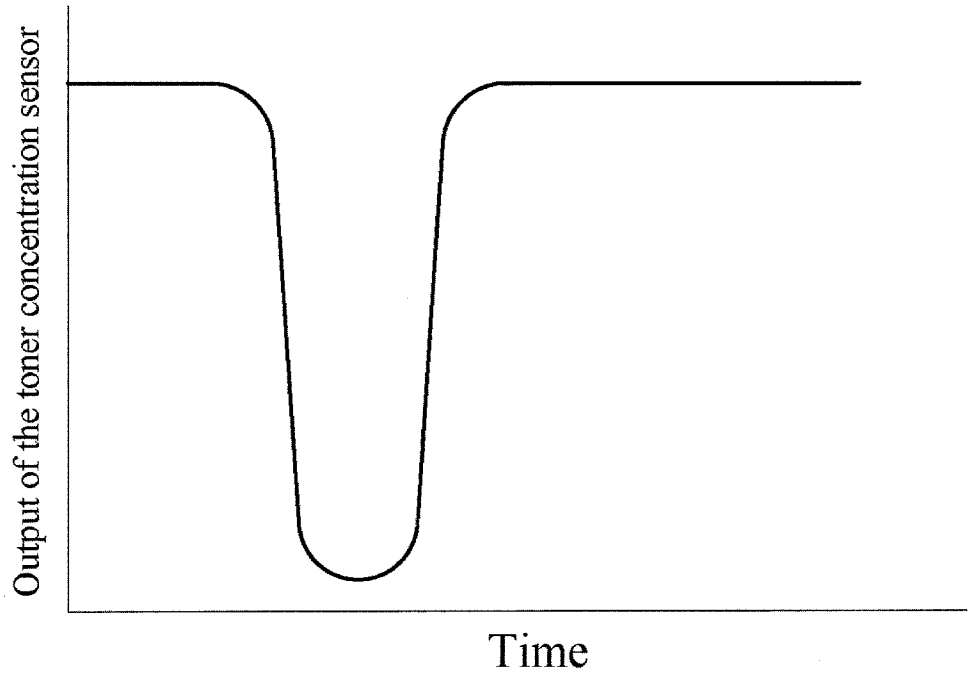
FIG. 6 is a graph showing a result of sensing of a resist pattern.

FIG. 6 shows a relationship between time and output obtained by sensing a resist pattern using the first light emitting element 31. The light radiated from the first light emitting element 31 has a wavelength of large reflectance on the intermediate transfer belt 10. Hence, when toner exists on the surface of the transparent film 39*a*, the light is absorbed or diffusely reflected by the toner. This significantly reduces the amount of light incident on the light receiving element 33. The valley portion in the graph of FIG. 6 indicates a large reduction in output, which is caused by the existence of the resist pattern. This ensures sensing of where on the intermediate transfer belt 10 the toner is attached.

Figure 7:
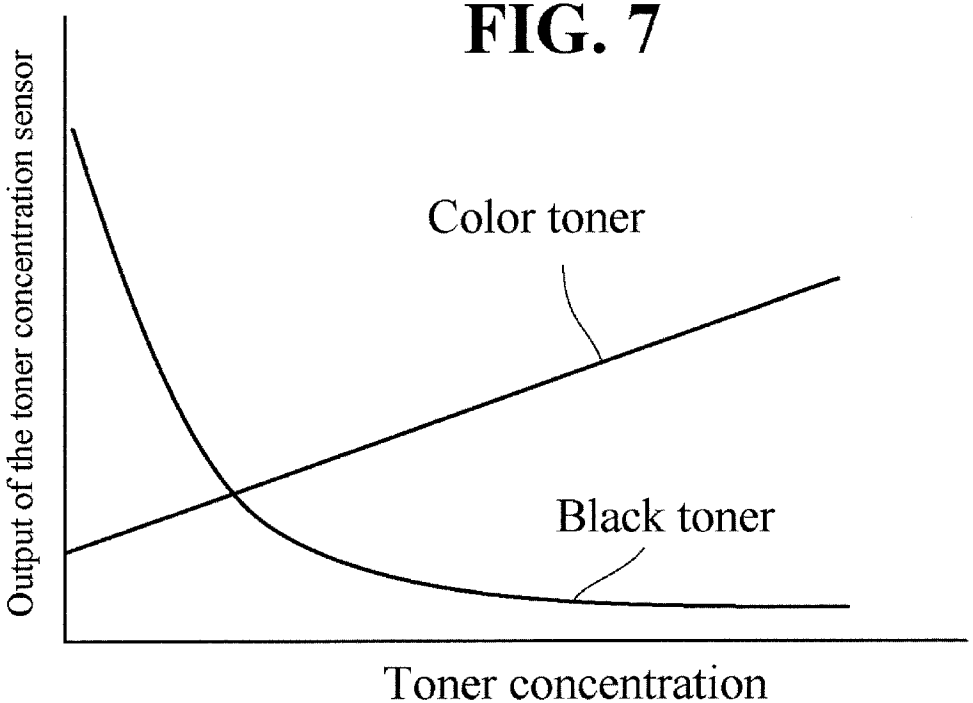
FIG. 7 is a graph showing a relationship between toner concentration and the output value of a light receiving element.

The first light emitting element 31 senses the concentration of black toner. Since black toner absorbs light, as the concentration increases, the reflectance decreases and the output of the light receiving element 33 weakens, as shown in FIG. 7. This relationship is used to sense the concentration of the black toner.

The second light emitting element 32 senses the concentration of color toner. When the second light emitting element 32 radiates light to a portion of the intermediate transfer belt 10 not attached with color toner, the amount of light reflecting from the portion of the intermediate transfer belt 10 and incident on the light receiving element 33 is significantly small. Contrarily, when the second light emitting element 32 radiates light to color toner, which is highly diffuse reflective, the amount of the reflecting light increases in proportion to the concentration of the color toner, as seen from the graph of FIG. 7. This relationship is used to sense the concentration of the color toner.

Figure 8:
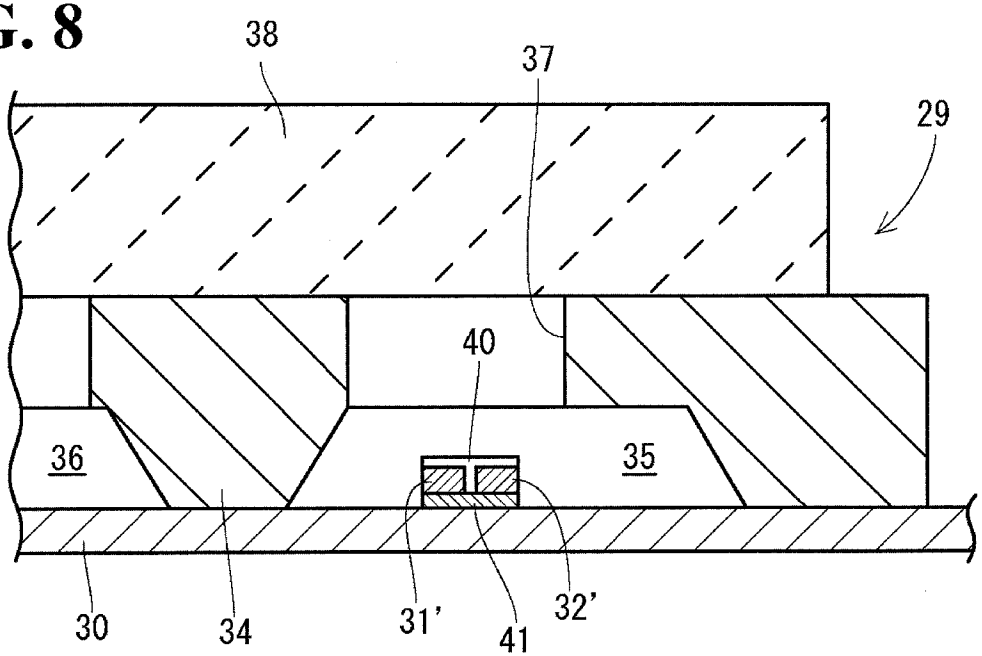
FIG. 8 is a partial cross-sectional view of a toner concentration sensor according to a second embodiment.

FIG. 8 shows a second embodiment, where the first light emitting element 31 and the second light emitting element 32 are integral with one another. Specifically, a first light emitting chip 31' serving as the first light emitting element 31 and a second light emitting chip 32' serving as the second light emitting element 32 are disposed on a common separate substrate 41 (the resulting assembly may be sealed with resin or other material).

This configuration ensures that the distance between the first light emitting chip 31' and the second light emitting chip 32' is smaller than the distance between the first light emitting element 31 and the second light emitting element 32 of the first embodiment, adding to compactness. The configuration also reduces the incident angle on the toner carrier, thereby further improving the sensitivity to toner concentration. The first light emitting chip 31' and the second light emitting chip 32' may alternatively be mounted on the print substrate 30.

With the embodiments of the present invention, the first light emitting element and the second light emitting element are distinguished from one another in that the first light emitting element radiates light that undergoes large specular reflection on the toner carrier, while the second light emitting element radiates light that undergoes approximately no specular reflection on the toner carrier. This ensures that the first light emitting element and the second light emitting element are disposed adjacent to one another. This also shortens the distance between the light receiving element and the first and second light emitting elements compared with the conventional art, resulting in a compact toner concentration sensor. Additionally, the incident angles and the reflection angles of light between the first and second light emitting elements and the light receiving element are diminished, thereby improving the sensitivity (accuracy) of the toner concentration sensor.

In the embodiments of the present invention, the wavelength of the light radiated from the second light emitting element may be such that the light radiated from the second light emitting element is reduced in intensity due to interference at the transparent film when the light is received by the at least one light receiving element. The wavelength of the light radiated from the first light emitting element may be such that the light radiated from the first light emitting element is increased in intensity due to interference at the transparent film when the light is received by the at least one light receiving element.

In the embodiments of the present invention, the first light emitting element may be configured to radiate light having a wavelength that causes specular reflection of the light on the toner carrier at equal to or higher than 95% of a maximum spectral reflectance of the toner carrier when the light is directly radiated to the toner carrier. The second light emitting element may be configured to radiate light having a wavelength that causes diffuse reflection of the light on the toner and minimum reflection on the toner carrier. This ensures highly accurate sensing of toner concentration.

In the embodiments of the present invention, the first light emitting element may include a first light emitting chip and the second light emitting element may include a second light emitting chip. The first light emitting chip and the second light emitting chip may be on a common substrate. This ensures that the distance between the first light emitting chip and the second light emitting chip is smaller than the distance between the first light emitting element and the second light emitting element, further adding to compactness and improved sensitivity.

The embodiments of the present invention are not intended to be construed in a limiting sense, and many other embodiments are possible. For example, the toner carrier will not be limited to an intermediate transfer belt but may be a photosensitive drum. It is also possible to use three or more light emitting elements.

The embodiments of the present invention have industrial applicability especially in, but not limited to, toner image forming apparatuses of printers and multifunctional machines.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus comprising:

a toner carrier comprising a substrate and a transparent film on a surface of the substrate;

a toner image forming unit configured to form a toner image onto the toner carrier; and at least one toner concentration sensor configured to sense a concentration of toner carried on the toner carrier, the toner concentration sensor comprising:

a first light emitting element and a second light emitting element different from the first light emitting element, the first light emitting element and the second light emitting element each being configured to radiate light directly or indirectly to the toner carrier; and at least one light receiving element configured to receive reflecting light originating from at least one of the first light emitting element and the second light emitting element, a reflection intensity of the reflecting light originating from the at least one of the first light emitting element and the second light emitting element and received by the at least one light receiving element being used to sense the concentration of the toner, wherein the first light emitting element is configured to radiate light having a wavelength that causes equal to or higher than a predetermined reflectance that is sensed by the at least one light receiving element when the light is radiated directly to the toner carrier, and wherein the second light emitting element is configured to radiate light having a wavelength that is different from the wavelength of the light radiated from the first light emitting element and that causes a lower reflectance resulting when the light is radiated directly to the toner carrier than a reflectance resulting when the light is radiated to the toner.

2. The image forming apparatus according to claim 1, wherein the wavelength of the light radiated from the second light emitting element is such that the light radiated from the second light emitting element is reduced in intensity due to interference at the transparent film when the light is received by the at least one light receiving element.

3. The image forming apparatus according to claim 2, wherein the wavelength of the light radiated from the first light emitting element is such that the light radiated from the first light emitting element is increased in intensity due to interference at the transparent film when the light is received by the at least one light receiving element.

4. The image forming apparatus according to claim 3, wherein the first light emitting element is configured to radiate light having a wavelength that causes specular reflection of the light on the toner carrier at equal to or higher than 95% of a maximum spectral reflectance of the toner carrier when the light is directly radiated to the toner carrier, and wherein the second light emitting element is configured to radiate light having a wavelength that causes diffuse reflection of the light on the toner and approximately no reflection on the toner carrier.

5. The image forming apparatus according to claim 4, wherein the first light emitting element comprises a first light emitting chip and the second light emitting element comprises a second light emitting chip, the first light emitting chip and the second light emitting chip being on a common substrate.

6. The image forming apparatus according to claim 3, wherein the first light emitting element comprises a first light emitting chip and the second light emitting element comprises a second light emitting chip, the first light emitting chip and the second light emitting chip being on a common substrate.

7. The image forming apparatus according to claim 2, wherein the first light emitting element is configured to radiate light having a wavelength that causes specular reflection of the light on the toner carrier at equal to or higher than 95% of a maximum spectral reflectance of the toner carrier when the light is directly radiated to the toner carrier, and wherein the second light emitting element is configured to radiate light having a wavelength that causes diffuse reflection of the light on the toner and approximately no reflection on the toner carrier.

8. The image forming apparatus according to claim 7, wherein the first light emitting element comprises a first light emitting chip and the second light emitting element comprises a second light emitting chip, the first light emitting chip and the second light emitting chip being on a common substrate.

9. The image forming apparatus according to claim 2, wherein the first light emitting element comprises a first light emitting chip and the second light emitting element comprises a second light emitting chip, the first light emitting chip and the second light emitting chip being on a common substrate.

10. The image forming apparatus according to claim 1, wherein the wavelength of the light radiated from the first light emitting element is such that the light radiated from the first light emitting element is increased in intensity due to interference at the transparent film when the light is received by the at least one light receiving element.

11. The image forming apparatus according to claim 10, wherein the first light emitting element is configured to radiate light having a wavelength that causes specular reflection of the light on the toner carrier at equal to or higher than 95% of a maximum spectral reflectance of the toner carrier when the light is directly radiated to the toner carrier, and wherein the second light emitting element is configured to radiate light having a wavelength that causes diffuse reflection of the light on the toner and approximately no reflection on the toner carrier.

12. The image forming apparatus according to claim 11, wherein the first light emitting element comprises a first light emitting chip and the second light emitting element comprises a second light emitting chip, the first light emitting chip and the second light emitting chip being on a common substrate.

13. The image forming apparatus according to claim 10, wherein the first light emitting element comprises a first light emitting chip and the second light emitting element comprises a second light emitting chip, the first light emitting chip and the second light emitting chip being on a common substrate.

14. The image forming apparatus according to claim 1, wherein the first light emitting element is configured to radiate light having a wavelength that causes specular reflection of the light on the toner carrier at equal to or higher than 95% of a maximum spectral reflectance of the toner carrier when the light is directly radiated to the toner carrier, and wherein the second light emitting element is configured to radiate light having a wavelength that causes diffuse reflection of the light on the toner and approximately no reflection on the toner carrier.

15. The image forming apparatus according to claim 14, wherein the first light emitting element comprises a first light emitting chip and the second light emitting element comprises a second light emitting chip, the first light emitting chip and the second light emitting chip being on a common substrate.

16. The image forming apparatus according to claim 1, wherein the first light emitting element comprises a first light emitting chip and the second light emitting element comprises a second light emitting chip, the first light emitting chip and the second light emitting chip being on a common substrate.

17. A toner concentration sensor comprising:

a first light emitting element and a second light emitting element different from the first light emitting element, the first light emitting element and the second light emitting element each being configured to radiate light directly or indirectly to a toner carrier, the toner carrier comprising a substrate and a transparent film over the substrate;

at least one light receiving element configured to receive reflecting light originating from at least one of the first light emitting element and the second light emitting element, the reflecting light being used to sense toner carried on the toner carrier, wherein the first light emitting element is configured to radiate light having a wavelength that causes equal to or higher than a predetermined reflectance when the light is radiated directly to the toner carrier, and wherein the second light emitting element is configured to radiate light having a wavelength that is different from the wavelength of the light radiated from the first light emitting element and that causes a lower reflectance resulting when the light is radiated directly to the toner carrier than a reflectance resulting when the light is radiated to the toner.

18. The toner concentration sensor according to claim 17, wherein the first light emitting element comprises a first light emitting chip and the second light emitting element comprises a second light emitting chip, the first light emitting chip and the second light emitting chip being on a common substrate.

* * * * *